US007189197B2

(12) United States Patent
Curt et al.

(10) Patent No.: US 7,189,197 B2
(45) Date of Patent: Mar. 13, 2007

(54) CENTRIFUGE WITH A SPLIT SHAFT CONSTRUCTION

(75) Inventors: Carey A. Curt, Cookeville, TN (US); Hendrik N. Amirkhanian, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 10/870,804

(22) Filed: Jun. 17, 2004

(65) Prior Publication Data

US 2005/0037909 A1 Feb. 17, 2005

Related U.S. Application Data

(60) Provisional application No. 60/494,241, filed on Aug. 11, 2003.

(51) Int. Cl.
*B04B 9/06* (2006.01)

(52) U.S. Cl. ..... 494/49; 464/182

(58) Field of Classification Search ..... 494/24, 494/36, 43, 49, 64, 65, 67, 83, 84, 901; 210/168, 210/171, 232, 360.1, 380.1, 416.5; 184/6.24; 464/179, 182

See application file for complete search history.

(56) References Cited

U.S. PATENT DOCUMENTS 687,676 A * 11/1901 Culver ..... 464/182
5,575,912 A 11/1996 Herman et al.
5,637,217 A 6/1997 Herman et al.
5,871,031 A * 2/1999 Greinacher
6,017,300 A 1/2000 Herman
6,019,717 A 2/2000 Herman
6,224,531 B1 * 5/2001 Frehland et al. ..... 494/49
6,454,694 B1 * 9/2002 Herman et al. ..... 494/49
6,821,241 B2 * 11/2004 Herman et al. ..... 494/49
6,893,389 B1 * 5/2005 South et al. ..... 494/49
2001/0029227 A1 * 10/2001 Herman et al. ..... 494/67
2005/0037909 A1 * 2/2005 Curt et al. ..... 494/49

FOREIGN PATENT DOCUMENTS

GB 2120134 A * 11/1983
WO 86/06984 * 12/1986

* cited by examiner

*Primary Examiner*—Charles E. Cooley
(74) *Attorney, Agent, or Firm*—Krieg DeVault LLP; J. Bruce Schelkopf, Esq.

(57) ABSTRACT

A centrifuge for separating out particulate matter from a fluid includes a rotor shell that is rotatably coupled to a shaft through a first bushing and a second bushing. The shaft includes a first shaft section that is detachably coupled to a second shaft section in order to make maintenance and assembly of the centrifuge easier by reducing the shaft clearance needed during disassembly and assembly of the centrifuge. The first shaft section includes a first bushing race around which the first bushing is rotatably received. The second shaft section includes an integrally formed bushing collar for supporting the second bushing and a second bushing race around which the second bushing is rotatably received. With such a construction, the size of the bushings in the centrifuge can be minimized, which in turn increases the operational speed of the centrifuge, thereby enhancing the particulate removal efficiency in the centrifuge.

21 Claims, 6 Drawing Sheets

CENTRIFUGE WITH A SPLIT SHAFT CONSTRUCTION

REFERENCE TO RELATED APPLICATIONS

The present application claims the benefit of U.S. Provisional Application No. 60/494,241, filed Aug. 11, 2003, which is hereby incorporated by reference in its entirety.

BACKGROUND

The present invention relates generally to centrifuges, and more specifically, but not exclusively concerns a centrifuge with a split shaft construction that simplifies centrifuge maintenance and at the same time permits the use of smaller bushings, which results in higher speeds that enhance the efficiency of the centrifuge in the removal of particulate matter from fluids.

Centrifuges are used in a variety of environments and applications in order to separate particulate matter from fluids. For instance, centrifuges are used to separate out particulate matter from lubricants in engines in order to prolong the life of the engine. When designing a centrifuge, rotational or operational speed of the centrifuge is always a concern. Generally, higher rotational speeds in the centrifuge tend to improve the separation efficiency of particulate matter from fluids, and conversely, lower speeds tend to reduce separation efficiency. A number of design considerations or factors may affect the operational speed of a centrifuge. Among these factors, one is the size of the bushings used in the centrifuge. In one typical centrifuge design, the centrifuge includes a fixed central shaft about which the rest of the components of the centrifuge, such as its rotor shell, rotate. A pair of bushings are usually fitted on opposite ends of the rotor in order to minimize friction between the shaft and the rotor shell. Bushing races are also formed at the opposite ends of the rotor, and the bushings engage the shaft at the races to minimize friction between the bushings and the shaft. Smaller bushing sizes in general permit higher operational speeds in the centrifuge, thereby improving separation efficiency; while larger bushing sizes usually reduce the operational speed of the centrifuge, which in turn reduces separation efficiency. The size or diameter of the shaft on which the bushings are fitted is a major factor that controls bushing size, and the strength of the shaft is always a concern that is weighed against shaft size when designing a centrifuge.

Traditional centrifuge shaft designs have been limited to two primary configurations, a shaft-spud assembly design (FIG. 1) and a one-piece shaft design (FIG. 2). In a shaft-spud assembly 30 design of FIG. 1, a shaft 31 is threadedly engaged to a spud 32. At one end, the shaft 31 has a housing collar 35 that is used for securing the shaft 31 to the housing of the centrifuge. Near the collar 35, the shaft 31 has a race surface 37 against which one of the bushings engages. In FIG. 1, the shaft 31 defines a fluid passageway 38 with outlet holes 39 for supplying fluid to the centrifuge. Opposite the collar 35 and around the fluid passageway 38, the shaft 31 has external threading 40 so that the shaft 31 can be secured inside a threaded opening 41 in the spud 32. The spud 32 has a race surface 42 around which the other bushing of the centrifuge is received and a retention collar 43 for retaining the bushing. As shown, the spud 32 has a threaded end 45 that is used to secure the centrifuge to other engine components, such as an engine block. Usually, the spud 32 is secured to the bottom of the centrifuge. Referring to FIG. 1, the spud 32 further defines a fluid inlet passageway 47 that supplies fluid to fluid passageway 38 in the shaft 31.

There are a number of drawbacks associated with the shaft-spud 30 design. For example, since the spud 32 is attached to the shaft 31 where the walls of the shaft 31 are relatively thin due to the fluid passageway 38, the spud 32 has to be relatively large. As a consequence, the larger sized spud 32 has a larger diameter race 42, which in turn increases the size of the bushing. As mentioned above, the larger sized bushing reduces the operational speed of the centrifuge, thereby reducing particulate separation efficiency of the centrifuge.

In the unitary or one-piece shaft 50 design of FIG. 2, smaller bushings (as compared to the shaft-spud assembly 30) can be used because the components of the spud 32, such as the collar 43 and race 42, are integrally formed on the shaft 50. However, many negative attributes arise with the one-piece shaft 50 design. For example, assembly and disassembly of the centrifuge becomes more difficult, especially in tight conditions, such as cramped engine compartments. Routine maintenance of centrifuges typically involves disassembly of the centrifuge housing assembly so that the used centrifuge rotor can be removed and replaced with a new, clean rotor. As illustrated in FIG. 2, the one-piece shaft 50 has a threaded end 51 on which a component similar to the collar 35 in FIG. 1 is secured, which in turn secures the shaft to the housing of the centrifuge. In one manner of disassembling the centrifuge, the collar component is removed from threaded end 51 of the shaft 50 so that the centrifuge rotor can be slid off the shaft 50. Due to the one-piece structure of the shaft 50, these components have to clear the entire length of the shaft 50 before they can be removed. As should be appreciated, the one-piece shaft 50 design makes removal of the centrifuge rotor extremely difficult, if not impossible, in cramped conditions. Thus, there remains a need for improvement in this field.

SUMMARY OF THE INVENTION

One aspect of the present invention concerns a centrifuge that includes a rotor shell that is rotatably coupled to a shaft through a first bushing and a second bushing. The shaft includes a first shaft section and a second shaft section. The first shaft section includes a first bushing race around which the first bushing is rotatably received. The second shaft section includes an integrally formed bushing collar for supporting the second bushing. The second shaft section includes a second bushing race around which the second bushing is rotatably received. The second shaft section defines a fluid passageway with a fluid outlet constructed and arranged to supply fluid to the centrifuge. The first shaft section and the second shaft section are detachably coupled together through a connection member to reduce clearance of the shaft during assembly and disassembly of the rotor shell.

Another aspect concerns a centrifuge that includes a rotor shell assembly. The rotor shell assembly includes a rotor shell with a first bushing and a second bushing. The centrifuge further includes a split shaft that includes a first shaft section and a second shaft section. The first shaft section includes a first bushing race around which the first bushing is rotatably received, and the first shaft section is solid. The second shaft section includes a second bushing race around which the second bushing is rotatably received. The second shaft section includes a bushing collar, and the second shaft section defines a fluid passageway with a fluid outlet constructed and arranged to supply fluid to the rotor shell assembly. A connection member detachably couples the first shaft section to the second shaft section to reduce clearance during replacement of the rotor shell assembly.

A further aspect concerns a centrifuge that includes a rotor shell. The rotor shell includes a first bushing and a second bushing. A split shaft defines a fluid outlet to supply fluid to the rotor shell, and the split shaft includes a first shaft section and a second shaft section. The first shaft section includes a first bushing race around which the first bushing is rotatably received, and the second shaft section includes a second bushing race around which the second bushing is rotatably received. A connector connects the first shaft section to the second shaft section. The connector is located outside of the first race and the second race to reduce size of the split shaft at the first race and the second race.

Still yet another aspect concerns a centrifuge that includes a rotor shell assembly. The rotor shell assembly includes a first bushing and a second bushing. A split shaft defines a fluid outlet from which fluid is supplied to the rotor shell. The shaft includes a connection member that is externally threaded. A first shaft section includes a first bushing race around which the first bushing is rotatably received, and the first shaft section defines a first connection cavity that is internally threaded. The connection member is threadedly engaged to the first connection cavity. A second shaft section includes a second bushing race around which the second bushing is rotatably received. The second shaft section defines a fluid passageway to supply fluid to the fluid outlet. The second shaft section defines a second connection cavity that is internally threaded, and the connection member is threadedly engaged to the second connection cavity to detachably couple to the first shaft section to the second shaft section.

Other aspects concern a unique centrifuge shaft, a unique method for the removal and replacement of centrifuge rotors.

Related objects and advantages of the present invention will be apparent from the following description.

DESCRIPTION OF SELECTED EMBODIMENTS

Figure 1:
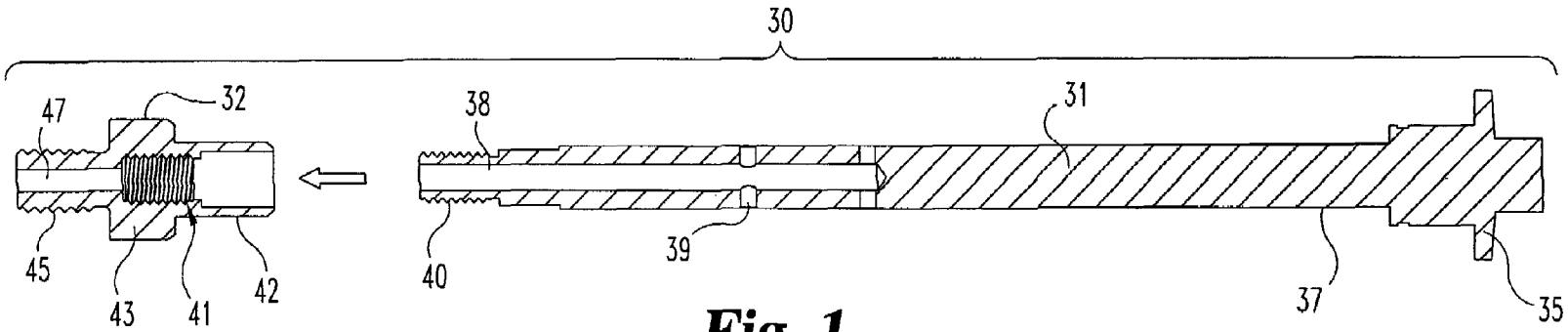
Fig. 1 (PRIOR ART)
FIG. 1 is a cross-sectional view in full section of a shaft-spud assembly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

It should be noted that the terms "upper" and "lower" as well as other directional indicators in the present application, such as "up" and "down", are merely used for the convenience of the reader so that the reader can readily locate components illustrated in the drawings and described herein. By no means is it intended by using this terminology that the present invention should be limited to a specific orientation of its components. For example, as should be appreciated, centrifuges and their components can have other orientations besides being vertically oriented.

For the sake of clarity and brevity, not all of the components of centrifuges will be described in detail in this specification. Rather, for a more detailed discussion of these and other centrifuge components please refer to U.S. Pat. Nos. 5,575,912; 5,637,217; 6,017,300; and 6,019,717, which are hereby incorporated by reference in their entirety. U.S. Pat. No. 5,575,912, which issued Nov. 19, 1996 to Herman et al., is also hereby incorporated by reference in its entirety. In addition, U.S. Pat. No. 5,637,217 which issued Jun. 10, 1997 to Herman et al.; U.S. Pat. No. 6,017,300 which issued Jan. 25, 2000 to Herman; and U.S. Pat. No. 6,019,717 which issued Feb. 1, 2000 to Herman are all hereby incorporated by reference in their entirety.

Figure 3:
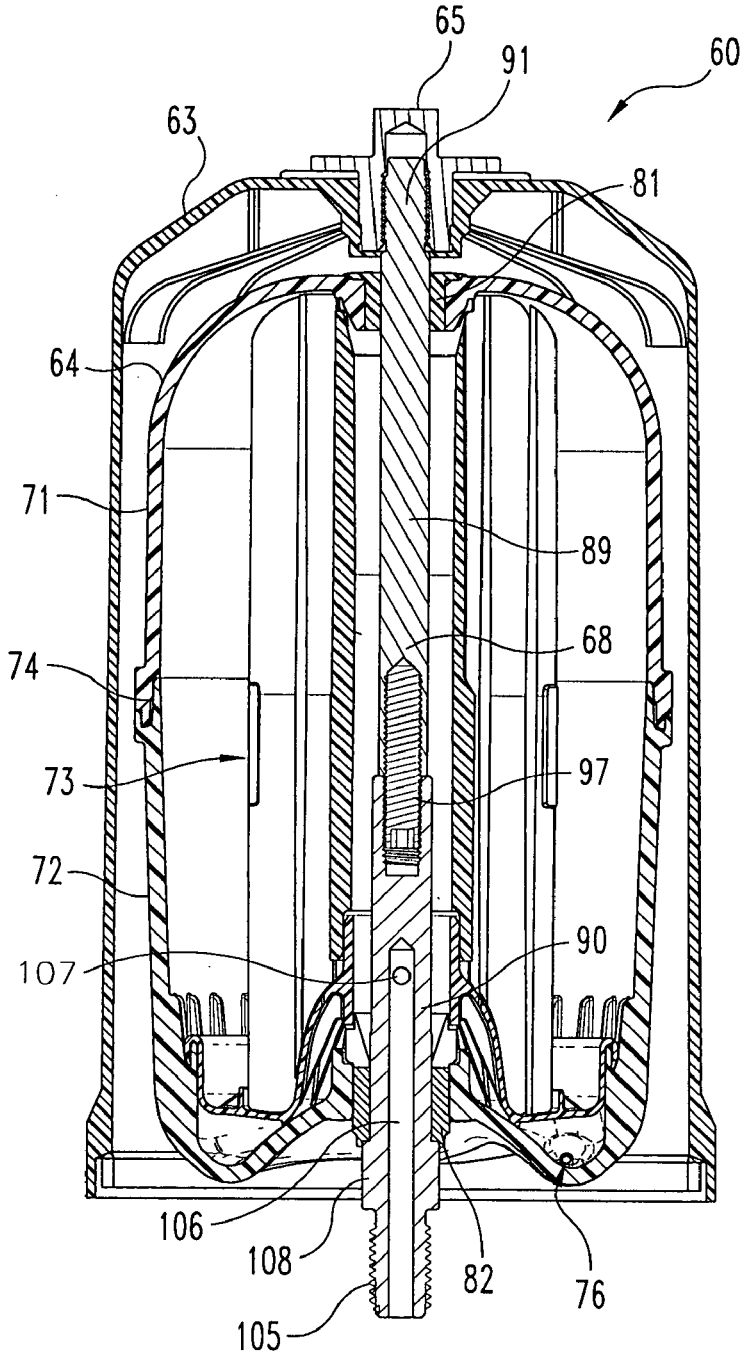
FIG. 3 is a cross-sectional view in full section of a centrifuge according to one embodiment of the present invention.

A centrifuge 60 according to one embodiment (among many) of the present invention is illustrated in FIG. 3. It is not intended that the present invention be limited to the centrifuge 60 illustrated in FIG. 3. Rather, it is contemplated that some or all of the features of the present invention can be incorporated into other types of centrifuges. Referring to FIG. 3, the centrifuge 60 includes a centrifuge housing 63 that encloses a rotor shell assembly 64. At an upper end of the housing 63, there is a collar member 65 that threadedly engages a split shaft assembly 68 according to one embodiment of the present invention. In the illustrated embodiment, the rotor shell assembly 64 includes an upper or first rotor shell 71, and a lower or second rotor shell 72 that together define a rotor shell cavity 73. The upper 71 and lower 72 rotor shells are joined together at joint 74 so as to form a unitary structure in which components inside the rotor shell assembly 64, such as cone stack and spiral vane assemblies, are housed.

The illustrated centrifuge 60 is a self-driven type centrifuge, that is one in which the fluid to be cleaned is used to drive the centrifuge 60. It nevertheless should be appreciated that the split shaft 78 can be used in other types of centrifuges. The lower rotor shell 72 in the illustrated embodiment has one or more drive jet openings 76 from which the fluid in the centrifuge 60 is discharged in order to rotate the rotor shell assembly 64 about the split shaft 68. The upper shell 71 has an upper or first bushing 81 upon which the upper rotor shell 71 rotates about the shaft 68. Likewise, the lower rotor shell 72 has a lower or second bushing 82 upon which the lower rotor shell 72 rotates about the shaft 68.

Figure 4:
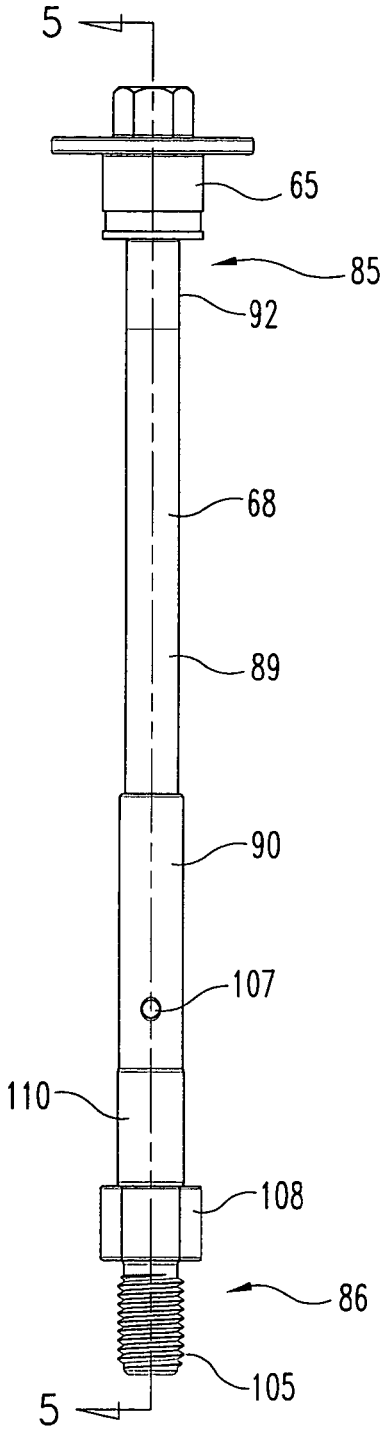
FIG. 4 is a front view of a split centrifuge shaft used in the FIG. 3 centrifuge.
Figure 5:
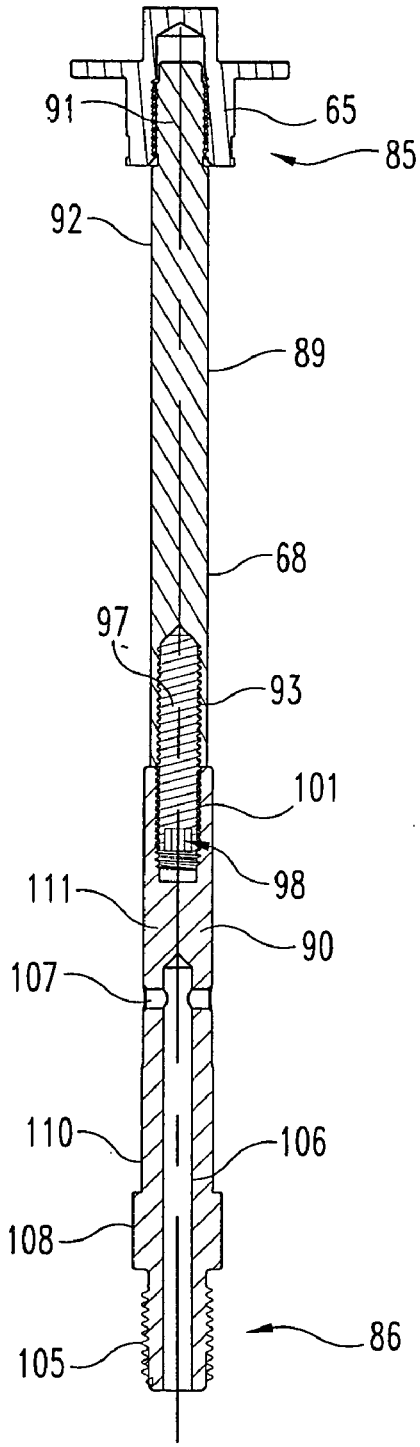
FIG. 5 is a cross-sectional view of the FIG. 4 shaft as taken along line 5—5 in FIG. 4.
Figure 6:
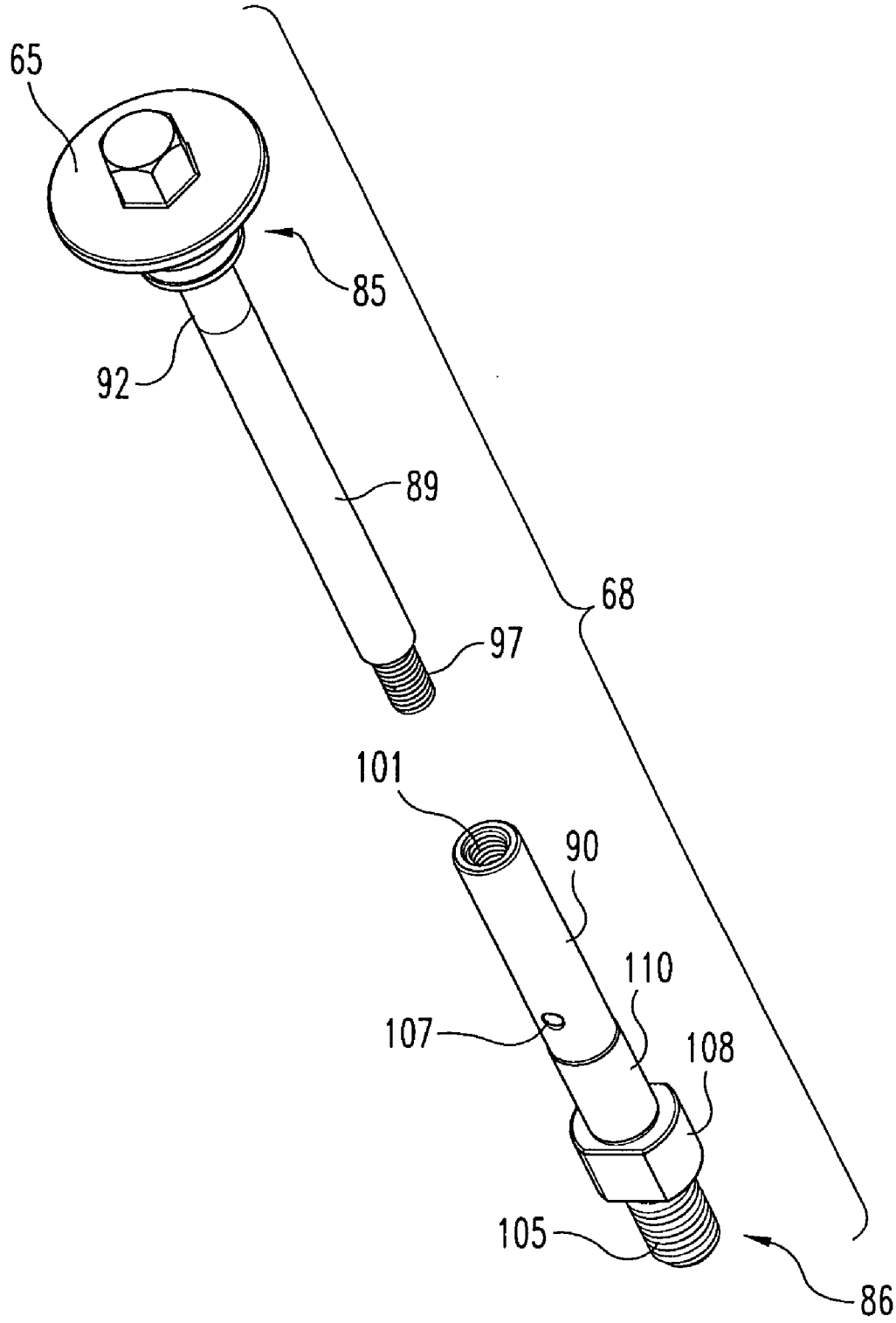
FIG. 6 is an exploded perspective view of the FIG. 4 split centrifuge shaft according to one embodiment of the present invention.

As illustrated in FIGS. 4, 5 and 6, the split shaft 68 has an upper (first) end 85 and an opposite, lower (second) end 86. Referring to FIG. 5, the split shaft 68 includes two separate sections, an upper or first shaft section (member) 89, and a lower or second shaft section (member) 90 that is detachably connected to the upper section 89. At the upper end 85 of the shaft 68, the upper section 89 has a collar engagement member 91 that engages the collar member 65. In the illustrated embodiment, the collar engagement member 91 is externally threaded to threadedly engage the collar member 65. Proximal the collar engagement member 91, the upper section 89 of the shaft 68 has a first or upper race surface 92 around which the upper bushing 81 rotates. Opposite the collar engagement member 91, the upper section 89 of the shaft 68 defines a first connection member cavity 93 in which a connection member 97 is received that secures the upper 89 and lower 90 sections together. Besides the first connection cavity 93, the rest of the upper section 89 is solid in order to strengthen the shaft 68.

In the embodiment depicted in FIG. 5, the connection member 97 is externally threaded, and the first connection cavity 93 is internally threaded in order to secure the connection member 97. In one form, the connection member 97 is in the form of a setscrew or a threaded stud. As shown, the connection member 97 defines a tool engagement cavity 98 that is used for engagement by a tool in order to screw the connection member 97 into the connection cavity 93. According to one form, the tool cavity 98 has a hexagonal shape in order to engage a hex wrench. However, it is contemplated that the tool cavity 98 can be shaped differently. The lower section 90 of the shaft 68, proximal the upper section 89 when assembled, has a second connection member cavity 101 in which the connection member 97 is received and secured. In one form, the second connection cavity 101 is internally threaded in order to threadedly engage the connection member 97. In a further form, an adhesive, such as a LOCTITE brand adhesive, can be used to further secure the connection member 97 in the connection cavities 93, 101. However, it is envisioned that the connection member 97 can connect the upper 89 and lower 90 sections in other manners. In the illustrated embodiment, the connection member 97 is initially a separate component from the upper 89 and lower 90 sections. It is contemplated that in other embodiments the connection member can be integrally formed with either the upper 89 or lower 90 section of the shaft 68.

With reference to FIG. 5, proximal the lower end 86 of the shaft 68, the lower section 90 has a shaft securing member 105 for securing the shaft 68 to a filter casting or other engine components, such as the engine block. In the embodiment depicted, the shaft securing member 105 is externally threaded so that member 105 can be screwed onto another engine component. Opening at the lower end 86 of the shaft 68, a fluid passageway 106 in the lower section 90 supplies fluid to the centrifuge 60 via one or more fluid outlet openings 107 in the lower section 90. Next to member 105, the lower section 90 has a bushing collar 108 that supports the rotor shell assembly 64 when the centrifuge 60 is at rest. Between the bushing collar 108 and the fluid outlet openings 107, the lower section 90 has a lower bushing race surface 110 around which the lower bushing 82 rotatably engages. Inside the lower section 90, in between the fluid passageway 106 and the second connection cavity 101, the lower section 90 in the illustrated embodiment has a portion 111 that is solid.

Figure 2:
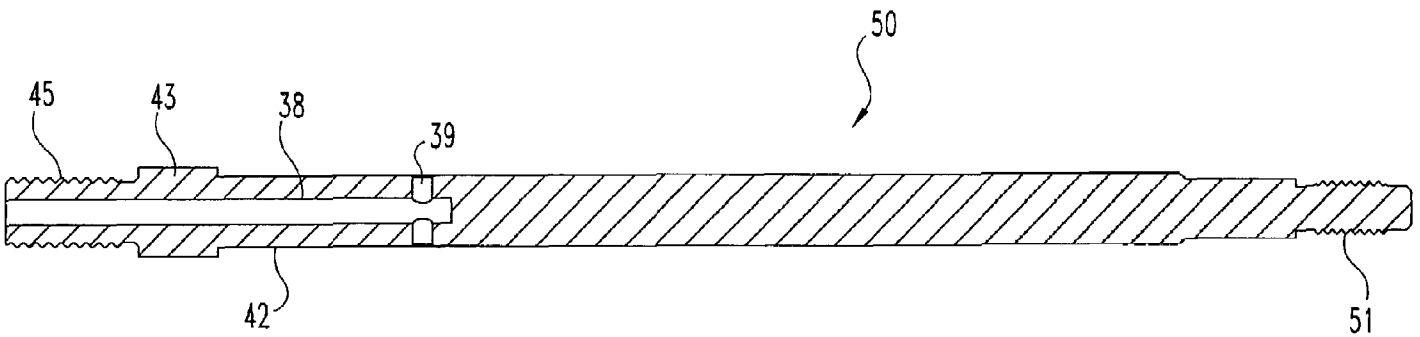
Fig. 2 (PRIOR ART)
FIG. 2 is a cross-sectional view in full section of a one-piece centrifuge shaft.

In the embodiment illustrated in FIG. 3, the connection between the upper 89 and lower 90 sections is made near the separation joint 74 of the upper 71 and lower 72 rotor shells. Nevertheless, the location of the connection between the upper 89 and lower 90 sections can be varied to accommodate different removal heights. During maintenance, the rotor shell assembly 64 can be removed by detaching the upper section 89 of the shaft 68 from the lower section 90. As should be appreciated, the rotor shells 71, 72 along with the bushings 81, 82 only have to slide off and clear one of the sections 89, 90 of the shaft 68. By having the two-part shaft construction, the split shaft 68 enables the rotor shell assembly 64 to be easily removed and replaced, even in tight conditions. In contrast to the one-piece shaft design 50 in FIG. 2, the components of the centrifuge 60 do not have to clear the entire length of the shaft 68 before the centrifuge 60 can be removed. Rather, the components only have to clear one of the sections 89, 90. As should be appreciated, the split shaft 68 according to the present invention also simplifies initial assembly and re-assembly of the centrifuge 60 because the components of the centrifuge 60 do not have to clear the entire length of the shaft 68. During assembly, the rotor shell assembly 64 is slid onto the sections 89, 90 of the shaft 68 before the sections 89, 90 are connected together with the connection member 97.

In the shaft 68 of FIG. 5, the connection between the sections 89, 90 is not made around the fluid passageway 106 and/or the lower bushing race 110 such that the size (diameter) of the lower bushing race 110 can be minimized. Minimizing the diameter of the lower race 110, minimizes the size of the lower bushing 82, which in turn increases the operational speed of the centrifuge 60. By having the sections 89, 90 connected at a location not near the bushing races 92, 110 and the fluid passageway 106, 107, the smaller bushings 81, 82 can be used while at the same time the centrifuge 60 can be easily assembled and disassembled.

Figure 7:
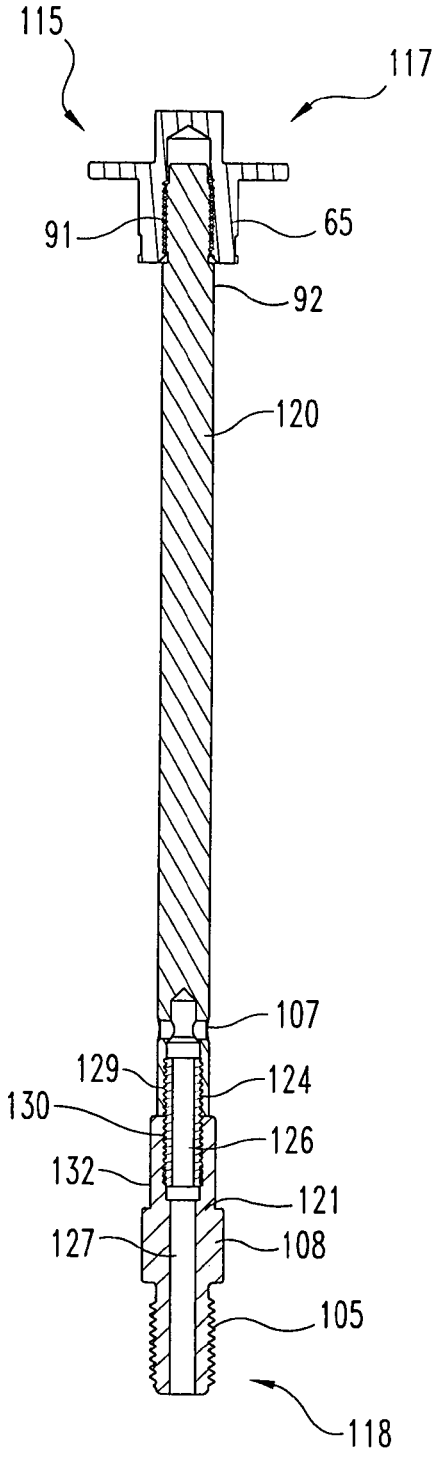
FIG. 7 is a cross-sectional view of a split centrifuge shaft according to another embodiment.

A split shaft 115 according to another embodiment is illustrated in FIG. 7. As illustrated, the split shaft 115 has an upper (first) end 117 and an opposite, lower (second) end 118. Further, the split shaft 115 includes two separate sections, an upper or first shaft section (member) 120, and a lower or second shaft section (member) 121 that is detachably connected to the upper section 120. At the upper end 117 of the shaft 115, the upper section 120 has a collar engagement member 91 that engages the collar member 65. Like the previous embodiment, the collar engagement member 91 is externally threaded to threadedly engage the collar member 65. Proximal the collar engagement member 91, the upper section 120 of the shaft 115 has upper race surface 92 around which the upper bushing 81 rotates.

In the embodiment shown in FIG. 7, the upper 120 and lower 121 sections of the shaft 115 are connected together with a hollow connection member 124. With this design, the lower section 121 of the shaft 115 controls the removal height for the centrifuge 60. The connection member 124 defines a fluid cavity 126 through which fluid from a fluid passageway 127 in the lower section 121 flows to one or more fluid outlets 107 in the upper section 120. The connection member in the illustrated embodiment is a hollow setscrew. As shown, the connection member 124 is externally threaded, and the connection member 124 is threadedly engaged in first 129 and second 130 cavities respectively formed in the upper 120 and lower 121 sections of the shaft 115. It also should be appreciated that an adhesive, such as a LOCTITE® brand adhesive, can be used to help further secure the connection member 124 in the connection cavities 129,130. In the illustrated embodiment, the connection member 124 is initially a separate component from the upper 120 and lower 121 sections. With the connection member 124, the upper 120 and lower 121 sections can be detached and reattached to one another, with a reduced removal height, such that routine maintenance and cleaning of the centrifuge 60 can be easily done.

Proximal the lower end 118 of the shaft 115, the lower section 121 has shaft securing member 105 for securing the shaft 115 to other engine components, such as the engine block. In the embodiment depicted, the shaft securing member 105 is externally threaded so that member 105 can be screwed onto another engine component. Opening at the lower end 118 of the shaft 115, the fluid passageway 127 in the lower section 121 supplies fluid to the centrifuge, and as mentioned above, the fluid cavity 126 in the connection member 124 transports the fluid to the fluid outlet openings 107 in the upper section 120. Next to the shaft securing member 105, the lower section 121 has a bushing collar 108 for retaining the lower bushing 82. Between the bushing collar 108 and the upper section 120, the lower section 121 has a lower bushing race surface 132 around which the lower bushing 82 rotatably engages.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge, comprising:

a rotor shell assembly including rotor shell with a first bushing and a second bushing;

a split shaft including a first shaft section including a first bushing race around which the first bushing is rotatably received, wherein the first shaft section is solid, a second shaft section including a second bushing race around which the second bushing is rotatably received, the second shaft section including a bushing collar, the second shaft section defining a fluid passageway with a fluid outlet constructed and arranged to supply fluid to the rotor shell assembly, and a connection member detachably coupling the first shaft section to the second shaft section to reduce clearance during replacement of the rotor shell assembly; and wherein the connection member is located outside of the fluid passageway with the fluid outlet and the second bushing race to reduce size of the split shaft.

2. The centrifuge of claim 1, further comprising a separation means received in the rotor shell for separating material from the fluid.

3. The centrifuge of claim 2, wherein the separation means includes a spiral vane assembly.

4. The centrifuge of claim 2, wherein the separation means includes a cone stack assembly.

5. The centrifuge of claim 1, further comprising: a housing enclosing the rotor shell assembly; and a collar member coupling the first shaft section to the housing.

6. The centrifuge of claim 1, wherein the rotor shell defines a drive jet opening for driving the rotor shell.

7. The centrifuge of claim 1, wherein the connection member includes a threaded set screw.

8. The centrifuge of claim 7, wherein the set screw defines a tool cavity for securing the split shaft.

9. The centrifuge of claim 1, further comprising an adhesive provided on the connection member to adhere the connection member to the first shaft section and the second shaft section.

10. The centrifuge of claim 1, wherein the second shaft section includes a shaft securing member that is externally threaded to secure the second shaft section to another engine component.

11. The centrifuge of claim 1, wherein the connection member is solid.

12. A centrifuge, comprising:

a rotor shell assembly including rotor shell with a first bushing and a second bushing; and a split shaft including a first shaft section including a first bushing race around which the first bushing is rotatably received, wherein the first shaft section is solid, a second shaft section including a second bushing race around which the second bushing is rotably received, the second shaft section including a bushing collar, the second shaft section defining a fluid passageway with a fluid outlet constructed and arranged to supply fluid to the rotor shell assembly, and a connection member detachably coupling the first shaft section to the second shaft section to reduce clearance during replacement of the rotor shell assembly; and wherein the first shaft section defines a first connection cavity in which the connection member is coupled to the first shaft section.

13. The centrifuge of claim 12, wherein the second shaft section defines a second connection cavity in which the connection member is coupled to the second shaft section.

14. The centrifuge of claim 13, wherein:

the first connection cavity and the second connection cavity are internally threaded; and the connection member is externally threaded.

15. A centrifuge, comprising:

a rotor shell including a first bushing and a second bushing; and a split shaft defining a fluid outlet to supply fluid to the rotor shell, the split shaft including a first shaft section including a first bushing race around which the first bushing is rotatably received, wherein the first shaft is solid, a second shaft section including a second bushing race around which the second bushing is rotatably received, and a connector that is a separate component from the first shaft and the second shaft, the connector connecting the first shaft section to the second shaft section, wherein the connector is located outside of the first race and the second race to reduce size of the split shaft at the first race and the second race.

16. The centrifuge of claim 15, wherein the second shaft section defines the fluid outlet.

17. The centrifuge of claim 16, wherein:

the second shaft section defines a fluid passage to supply the fluid to the fluid outlet; and the second shaft section has a bushing collar for supporting the second bushing.

18. The centrifuge of claim 15, wherein the connector includes a screw.

19. A centrifuge, comprising:

a rotor shell assembly including a first bushing and a second bushing; and a split shaft defining a fluid outlet from which fluid is supplied to the rotor shell, the shaft including a connection member that is externally threaded, a first shaft section including a first bushing race around which the first bushing is rotatably received, the first shaft section defining a first connection cavity that is internally threaded, the connection member being threadedly engaged to the first connection cavity, a second shaft section including a second bushing race around which the second bushing is rotatably received, the second shaft section defining a fluid passageway to supply fluid to the fluid outlet, the second shaft section defining a second connection cavity that is internally threaded, the connection member being threadedly engaged to the second connection cavity to detachably couple to the first shaft section to the second shaft section.

20. The centrifuge of claim 19, wherein:

the fluid outlet is defined in the first shaft section; and the connection member is hollow to allow passage of the fluid from the fluid passageway to the fluid outlet.

21. The centrifuge of claim 20, wherein: the fluid outlet is defined in the second shaft section; and the connection member is solid.

* * * * *